United States Patent [19]

Greer

[11] 3,973,417

[45] Aug. 10, 1976

[54] APPARATUS FOR THERMOSOL DYEING OF POLYESTER FABRICS

[75] Inventor: James E. Greer, Greensboro, N.C.

[73] Assignee: Burlington Industries, Inc., Greensboro, N.C.

[22] Filed: Dec. 16, 1974

[21] Appl. No.: 533,164

Related U.S. Application Data

[62] Division of Ser. No. 367,360, June 6, 1973, Pat. No. 3,895,909.

[52] U.S. Cl. ..... 68/19.1; 34/4; 34/41; 68/20; 118/33; 118/67; 118/69; 219/388

[51] Int. Cl.[2] ..... D06B 3/10

[58] Field of Search ..... 68/5 D, 5 E, 19, 19.1, 68/20, DIG. 5; 34/1, 4, 41, DIG. 10; 8/2, 176; 219/354, 388; 118/33, 67, 69

[56] References Cited

UNITED STATES PATENTS

| | | | |
|---|---|---|---|
| 2,663,612 | 12/1953 | Gibson | 8/176 X |
| 2,696,098 | 12/1954 | Erikson et al. | 68/20 X |
| 2,777,750 | 1/1957 | Sprague et al. | 68/5 D X |
| 3,233,961 | 2/1966 | Salvin et al. | 8/176 X |
| 3,409,460 | 11/1968 | Mitchell et al. | 34/4 X |
| 3,503,134 | 3/1970 | Fleissner | 68/DIG. 5 |

OTHER PUBLICATIONS

"Phenomel Drying in Textile Mills with Modern Infrared Ovens," Bulletin No. 50–544–64E (1964), of the Fostoria Corporation.

*Primary Examiner*—Philip R. Coe
*Attorney, Agent, or Firm*—Cushman, Darby & Cushman

[57] ABSTRACT

Apparatus for thermosol dyeing polyesters where the thermosoling is accomplished by a two-zone infrared oven having multiple infrared quartz rods and employing at least two radiometers to control the temperature followed by an immediate quenching step, all while the polyester is still under tension.

4 Claims, 1 Drawing Figure

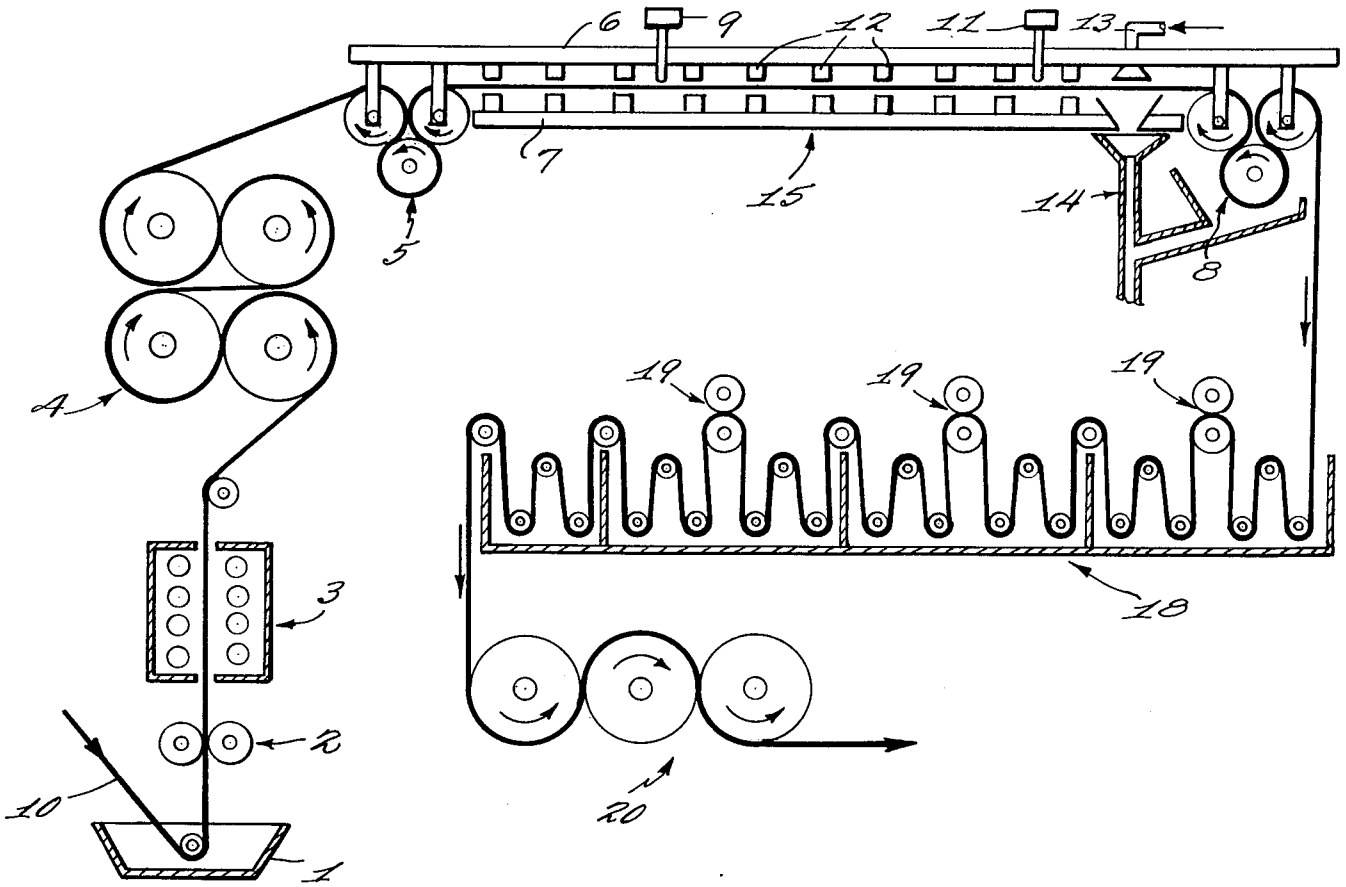
1
2
3
4
5
6
7
8
9
10
11
12
13
14
15
16
17
18
19
20

APPARATUS FOR THERMOSOL DYEING OF POLYESTER FABRICS

This is a division, of application Ser. No. 367,360 filed June 6, 1973, now U.S. Pat. No. 3,895,909.

BACKGROUND OF THE INVENTION

The present invention relates to the thermosoling of dyed polyester in the form of, for example, seat belts, tapes, ribbons and narrow fabrics.

Infrared fixation of dyed polyester/cotton fabrics is known in the art and is disclosed in U.S. Pat. No. 3,576,589. Infrared fixation is also used on other cellulosic textiles as evidenced by U.S. Pat. No. 2,992,878; 2,961,288; 3,101,236 and 3,233,961.

However, polyesters dyed by these infrared thermosoling processes still exhibit crocking problems, impermissible elongation of the polyester fabric and shiny or inadequate shading.

It is, therefore, an object of this invention to improve infrared thermosoling to eliminate crocking and reduce the elongation to a permissable level.

It is also an object of the invention to improve the depth of the dyed shade of the polyester.

DESCRIPTION OF THE INVENTION

The above objects are attained by passing the polyester material to be dyed under tension into a two-zoned infrared oven after the dyeing step, and subsequently quenching the material after it emerges from the oven while still under tension and before it contacts any holding or restraining rolls. The two-zoned infrared oven allows more uniform heat control and better thermosoling over prior art methods. The immediate cold quench is necessary while the polyester material is still under the tension provided by the restraining rolls and before the polyester cools in order to avoid crocking, glazed shade and minimize elongation problems. A further advantage of the present invention lies in the ability to stop the moving polyester in the oven without having the polyester break due to burning. In contrast, conventional hot air thermosoling on polyester materials stopped in the oven results in the material being burnt into two pieces which not only hurts the quality of the material, but also results in a considerable waste of material.

All types of conventional polyesters or polyester blends may be used in the present invention and can be described as sythetic polymers composed from an ester of a dihydric alcohol and terephthalic acid. Examples of some commercial polyesters are Dacron, Fortrel and Kodel. Such polyesters are used for tire fabrics, seat belts, clothing fabrics and other various uses. The present invention is particularly suitable for polyester seat belts which must meet strict elongation and quality dyeing standards. The polyesters to be dyed and the particular dyes used in the present invention are not critical to the present invention and various suitable dyes and polyesters are well known in the art.

Any suitable infrared source may be used in the present invention so long as it can raise the temperature of polyester up to at least 425°F. The preferred infrared source is composed of a series of multiple infrared quartz lamps commercially available and known as infrared quartz rods.

Apparatus suitable for carrying out the present invention is shown in the FIGURE. The material 10 to be dyed is taken off a supply roll not shown or from other processing equipment. The material 10 is fed into a dyeing apparatus which may be any suitable type of apparatus, such as pad dyeing, space dyeing, etc. Shown in the FIGURE is a pad dyeing apparatus having a pad pan 1 and pad rolls 2. The material 10 is subsequently fed into pre-dryer 3 and then onto hot dry cans 4.

The infrared thermosoling is accomplished in an infrared oven 15 having two controlled zones which employ any suitable infrared heat source 12. The preferred embodiment uses a multiple infrared source 12 comprising quartz rods. The first zone is controlled by any suitable mechanism to bring the material 10 up to thermosoling temperature, i.e., 400°F. The preferred apparatus employs a radiometer 9 to control the temperature of the oven and material 10 in the first zone. The second zone is controlled by radiometer 11 in order to keep the material 10 at a constant thermosoling temperature.

The first zone is preferably controlled to bring the polyester up to a temperature in the range of about 400°F to about 410°F and while in the second zone the material 10 is preferably held at the thermosoling temperature of about 400°F. However, depending on the required properties of the fabric and dye the temperature of the textile material may be generally controlled in the range of about 380° to about 425°F.

For convenience, the infrared oven may be constructed out of I-beams 6 and 7 from which are suspended the infrared sources 12 and suitable control mechanisms. The I-beams 6 and 7 separate to two sets of restraining rolls 5 and 8 in order to maintain the tension on the material 10 as it passes through the infrared oven.

Following the infrared oven, the material 10 is subjected to a cold spray or quench 13. The material may be submerged in a separate quench bath or merely sprayed with a cold inert liquid such as water. It is preferred to use a cold water spray 13 having a detergent added to the water and a drain 14 so that the material 10 can pass in a straight line in and out of the oven without touching a hot roll.

Although plain cold water may be used, it is preferred to use a water solution containing a surfactant to attain uniform quenching. Any suitable surfactant may be used such as anionic, cationic or nonionic surfactants. Especially preferred are any of the commercially available detergents. The immediate, cold quenching by spraying on a cold water-detergent solution is applied to the polyester while it is still hot just as it emerges from the second or holding zone. This quenching takes place before the polyester contacts the last set or exit holding rolls, while the polyester is still under tension. When this is done the loose dyestuffs, the thickeners in the dye solution, and the dispersing agents if present in the dispersed dyes, simply boil off the very hot belt which is at a temperature of about 400°to about 410°F.

The material then travels around the second set of restraining rolls 8 and into a washing box apparatus 18. Washing means 18 is divided up into separate compartments to accomplish various well known washing and rinsing steps. Squeeze rolls 19 are provided where necessary. The material 10 finally passes through a drying means, such as drying cans 20, and onto further manufacturing processes or a reel. After washing through the usual wash boxes 18 using only plain hot water, followed by drying on dry cans, the following excellent results are achieved:

a. Excellent crock fastness, both wet and dry.
b. Deep full shades — such as a very deep black — which is most difficult to dye by conventional hot air thermosol methods.
c. Excellent elongation results of 4 to 9% are achieved without the serious difficulty encountered when using conventional hot air thermosoling methods.
d. Soft flexible hand is obtained on polyester seat belting. This is much more desirable than stiff belting material obtained when conventional hot air thermosol roller oven is used.
e. Full, non-shiny, dull deep shades were obtained by the present method. Whereas polyester belt with the same dye padding solution dyed in a conventional hot air, roller thermosol oven showed a very distinct drop in shade of the black.

The present invention is further illustrated by the following examples:

EXAMPLE 1

Celanese Fortrel polyester belt material was padded with 100 grams/liter Harshaw Estracyl Black GLH thickened with 20 grams/liter Superclear gum. The temperature of the padding was 160°F. This belt was pre-dyed and then dryed on dry cans. The dye liquor wet pickup was calculated and measured by weighing the belt before padding and after padding. The pickup was 34% of the 100 grams/liter of Estracyl Black GLH.

In order to determine the b est tension conditions for thermosoling, the dryed belt with the unfixed dye was then mounted in a frame that had a pair of spring scales connected by a double pulley to one end. The other end was fixed to the frame. The frame and belt were then put into an electric oven at 400°F; another piece was also exposed at 380°F; and still another at 425°F. The amount of tension on the contracting belt was then recorded. Exposure time was 4½ minutes.

At 380°F, 100 pounds tension is on the spring.
At 400°F, 200 pounds pull is on the spring.
At 425°F, 300 pounds pull is on the spring. But the belt is stiff and damaged by the heat.

With 200 pounds pull on each belt as it enters the oven at 410°F, the polyester belt is set so it does not shrink during thermosoling. The elongation with 300 pounds pull is about 5%.

The thermosoling was carried out by passing the predried belt through a set of restraining rolls, into a radiometer meter controlled infrared electric quartz rod oven which is in two zones. The first zone is used to heat the belt up to 400°F, i.e., the thermosoling temperature. A thermocouple was inserted into the belt to determine how long it takes to heat the belt to a thermosoling temperature of 400°F in a hot air and in an infrared oven:

1. In a radiometer controlled infrared oven it takes 9 seconds to raise the belt to 400°F.
2. In a conventional hot air oven it takes 3 minutes to raise the belt to 400°F.
3. In a radiometer controlled infrared oven it requires 16 seconds exposure to 400°F to complete the oven thermosoling of the color and full development of the shade.
4. In the conventional hot air oven it requires 90 seconds exposure to 400°F to complete the thermosoling after the belt has first been raised to 400°F. Thermocouples injected into the belt were used to measure these temperatures and an accurate stopwatch was used to measure the time of exposure.

While the belt was passing through the radiometer controlled two-zone infrared oven, careful control of the voltage was maintained in the infrared quartz rods so the desired temperature would be maintained. Four hundred volts were maintained in the first section. The temperture was measured with an infrared radiometer reading at the 5 micron range. The belt, now up to 410°F, was passed continuously into the next section where the voltage through the infrared quartz rods was modulated to 150–200 volts by a second infrared radiometer holding the temperature at 400°F for 16 seconds exposure. This gave full, complete development of the dye. While the belt was still under tension and before it was passed around the second set of restraining rolls, a spray of cold water was directed onto the 400°F belt.

For comparison a belt was thermosoled in a conventional hot air thermosol gas-fired oven; the belt passed over 24 hot stainless steel rolls while in the oven. Exposure time in the oven was 4 minutes, 55 seconds. The belt then emerges out of the oven, passes over the restraining rolls, then down to a cold water wash box. The shade on the hot air thermosoled belt was much lighter and more shiny as compared to the belt from the infrared thermosoled oven. Viewed at certain angles, the black of the infrared thermosoling appears about 40% deeper than the belt pulled through the hot air oven that had 25% more dye padded on the belt (125 grams/liter). The infrared thermosoled belt was then checked for elongation and thickness. It had a very low elongation (4%). The tensile strength was 6250 pounds. Light fastness was good — slight break only after 150 hours exposure to the Fadometer.

If the black dispersed dye concentration is increased in the conventional hot air process to compensate for the loss of depth, then the crock fastness becomes unacceptably worse. Repeated scouring with caustic soda/sodium hydrosulphate does not improve the crock fastness to the level of quality obtained by the infrared thermosoling.

A further sample was made using a grey shade instead of the black. The results were similar showing that the radiometer controlled infrared oven is far superior to the gas-fired oven. In place of the polyester belt material, fragile polyester ribbon material of ¼ inch to 1½ inches widths were also successfully run through the infrared oven. Green and red dyes were also employed with similar successful results. Optimum accuracy of the radiometers is obtained if the radiometers are set to read in the 5 micron range. At this range the humidity, dye color and stray radiation or convection heat do not influence the accurate control of the temperature of the material.

It is very surprising and unexpected that experiments showed such excellent results for infrared thermosoling without the usual caustic soda/sodium hydrosulphate baths that are used in the conventional hot air roller oven thermosol procedure. All the desirable properties in polyester seat belting, full deep shades, dull and not shiny, soft hand and excellent crocking fastness, and excellent low elongation were obtained in one pass through the infrared thermosoling process. Excellent light fastness also is obtained. For example, blacks were dyed that showed 150 hours light fastness in a weatherometer with no more than a trace of a break. Blues, greens, and other colors were also dyed with excellent light fastness results. Using conventional hot air thermosol roller oven procedures, all these desirable features cannot be obtained on one piece of polyester material in one pass as has been achieved by the present invention.

EXAMPLE 2

The following experiments were conducted to show the comparison of conventional thermosoling, the present infrared thermosoling, and the present infrared thermosoling without the quench treatment. Both duPont Dacron and Celanese Fortrell polyesters were run in the following processes. For the duPont fabric, 7,500 grams of Estracyl Black GLH, 200 grams of Mannotex RS (thickening agent) and 25 cc of acetic acid were mixed to form an 80 liter dye solution. For the Celanese Fortrel fabric, 10,000 grams of Estracyl Black GLH, 200 grams of Mannotex RS and 25 cc of acetic acid were mixed to make 80 liters of a dye solution. The speed of the machine shown in the FIGURE was set at 18 yds/min. The following steps were then conducted on each of the fabrics:

| | |
|---|---|
| 1) Pad No. 1 pressure | 50 lbs. |
| Pad No. 2 pressure | 50 lbs. |
| Temperature (pad) | 155°F. |
| 2) Gas fired pre-dry 4 burners | |
| 3) Thermosoling | |

A. Infrared oven of 48 Westinghouse T 16 rods 100 watts/inch and then spray the hot belt as it emerges from oven with a cold detergent solution of

| | |
|---|---|
| (Mikon No. 10) | 25 grams |
| (Tetra Soda PyroPhosp.) | 10 grams |
| | 1000 cc (liter) |

or

B. Same as (A), only omitting the quench step;

or

C. Conventional-thermosoling of a 100 yd. oven and steam at 214°F with a capacity of 150 yds. for each strand.

| | |
|---|---|
| 4) Hot Wash | Box 1 |

-continued

| | |
|---|---|
| 5) Tumbling boil wash | Box 2 |
| 6) Tumbling boil wash | Box 3 |
| 7) Hot water wash | Box 4 |
| 8) Hot water wash | Box 5 |
| 9) Hot water wash | Box 6 |
| 10) Warm water wash spray | Box 7 |
| 11) Squeeze | |
| 12) Apply finish | |
| 13) Dry on dry cans — graduated temperature | |

The conventional procedure included a stripping agent of caustic 25 gr/l. and, hydrosulphite soda 25 gr/l. at 140°F. in boxes No. 2 and No. 3. Samples of the conventionally thermosoled — hydro/caustic stripped polyester were checked (both Dacron and Fortrel) for crocking and the results were poor to unacceptable. The results of the three processes were as follows:

| | | Conventional (3C) Hot air oven Thermosol 100 yd. oven 150 yd. steamer DuPont Celanese | | Infrared (3A) Oven — Spray Cold detergent water quenched under tension DuPont Celanese | | Infrared (3B) Oven — Without quench in cold water detergent DuPont celanese | |
|---|---|---|---|---|---|---|---|
| Crocking | Dry | Poor | Poor | OK | OK | Poor | Poor |
| | Wet | Poor | Poor | OK | OK | Poor | Poor |
| Buckle Abrasion | | | | | | | |
| A) With Polyethylene (Polyethylene Emulsion 60G/L padded on wet. Aerotex softner TFL) | | OK | OK | OK | OK | OK | OK |
| B) Without Polyethylene (Polyethylene Emulsion 60 G/L padded on wet. Aerotez softener TFL) | | Makes Crocking Worse Abrades | Abrades | Does Not Hurt Crocking OK | OK | Makes Crocking Worse Abrades | Abrades |
| C) With Silicone | | Makes Crocking Worse | | Does Not Hurt Crocking | | Makes Crocking Worse | |
| D) With Rhoplex | | Makes Crocking Worse | | Does Not Hurt Crocking | | Makes Crocking Worse | |
| E) With Rhoplex and Polyethylene (mixed 60 gr. each per liter) | | Makes Crocking Worse | | Does Not Hurt Crocking | | Makes Crocking Worse | |

Thus, it is clear that the infrared thermosoling with the quench treatment while the fabric is still under tension produces superior and unexpected results over conventional hot-air thermosoling and infrared thermosoling without the quench.

What is claimed:

1. Apparatus for dyeing polyester material comprising means for feeding a continuous piece of polyester material through means for dyeing the polyester, means for predrying the polyester, means for thermosoling the polyester comprising a two-zone infrared oven, means for keeping the polyester under tension during the thermosoling, said tension means being positioned at the entrance and exit end of said thermosoling means such that the polyester material is out of contact with said tension means during thermosoling, means for quenching the polyester after the thermosoling, but before the polyester contacts said tension means at the exit of said thermosoling means, and means for washing and then drying the polyester.

2. Apparatus according to claim 1, wherein the infrared oven contains at least two radiometers and multiple infrared quartz rods.

3. Apparatus for dyeing polyester material comprising means for continuously feeding polyester material through means for dyeing the polyester material, predrying means for predrying the polyester material after the predrying material has passed through the dyeing means, thermosoling means for thermosoling the polyester material, first and second tensioning means for applying tension to the polyester material while the polyester material is fed through said thermosoling means, said first tensioning means being positioned at the entrance of said thermosoling means and said second tensioning means being positioned at the exit of said thermosoling means such that said polyester material is out of contact with said first and second tensioning means during thermosoling, quenching means positioned between the exit of said thermosoling means, and said second tensioning means, and means for after-treating the polyester material after the thermosoling.

4. Apparatus as claimed in claim 3 wherein said quenching means is comprised of means for forming a water spray for contacting said polyester material and drain means for collecting the water spray following quenching.

* * * * *